US011326743B2

(12) United States Patent
Wang et al.

(10) Patent No.: US 11,326,743 B2
(45) Date of Patent: May 10, 2022

(54) LED LIGHT APPARATUS

(71) Applicant: XIAMEN ECO LIGHTING CO. LTD., Xiamen (CN)

(72) Inventors: Qiyuan Wang, Xiamen (CN); Liangliang Cao, Xiamen (CN); Hongkui Jiang, Xiamen (CN); Huiwu Chen, Xiamen (CN); Wei Liu, Xiamen (CN); Feihua He, Xiamen (CN); Yanzeng Gao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/143,452

(22) Filed: Jan. 7, 2021

(65) Prior Publication Data

US 2021/0156523 A1 May 27, 2021

Related U.S. Application Data

(63) Continuation of application No. 16/126,961, filed on Sep. 10, 2018, now Pat. No. 10,914,428.

(30) Foreign Application Priority Data

Feb. 22, 2018 (CN) ..... 201821354071.1
Aug. 8, 2018 (CN) ..... 201810895529.2

(51) Int. Cl.

| | |
|---|---|
| ***F21K 9/232*** | (2016.01) |
| ***F21V 23/00*** | (2015.01) |
| ***F21K 9/238*** | (2016.01) |
| ***F21K 9/235*** | (2016.01) |
| ***F21V 3/06*** | (2018.01) |
| ***F21V 25/10*** | (2006.01) |
| ***F21V 29/70*** | (2015.01) |
| ***F21V 23/06*** | (2006.01) |
| *F21Y 115/10* | (2016.01) |

(52) U.S. Cl.

CPC ..... *F21K 9/232* (2016.08); *F21K 9/235* (2016.08); *F21K 9/238* (2016.08); *F21V 3/061* (2018.02); *F21V 23/005* (2013.01); *F21V 23/06* (2013.01); *F21V 25/10* (2013.01); *F21V 29/70* (2015.01); *F21Y 2115/10* (2016.08)

(58) Field of Classification Search

CPC ..... F21V 23/06; F21V 23/005; F21V 23/003; F21K 9/232; F21K 9/235; F21K 9/238

See application file for complete search history.

(56) References Cited

U.S. PATENT DOCUMENTS

| | | | | |
|---|---|---|---|---|
| 9,997,690 | B1 * | 6/2018 | Cao | H01L 33/483 |
| 2013/0271989 | A1 * | 10/2013 | Hussell | F21K 9/232 362/249.02 |
| 2019/0257478 | A1 * | 8/2019 | Wang | F21V 23/06 |

* cited by examiner

*Primary Examiner* — Kevin K Pyo

(74) *Attorney, Agent, or Firm* — Chun-Ming Shih; Lanway IPR Services

(57) ABSTRACT

A LED light apparatus includes a substrate, LED modules, a driver circuit, a fluorescent layer, a connector and a light passing shell. The LED modules are mounted on the substrate. The fluorescent layer covers the driver circuit and the LED modules. The connector has a first end electrically connecting to the driver circuit. The light passing shell encapsulates the substrate, the plurality of first LED modules, the driver circuit, the first fluorescent layer and at least a part of the connector. The connector has a second end connecting to an external power source.

20 Claims, 12 Drawing Sheets

LED LIGHT APPARATUS

RELATED APPLICATION

The present application is a continued application of U.S. application Ser. No. 16/126,961.

FIELD OF INVENTION

The present invention is related to a LED light apparatus and more particularly related to a LED light apparatus with compact structures.

BACKGROUND

There are various lighting devices designed for satisfying different needs. For example, there are light bulbs to be installed on sockets. Such light bulbs are usually easy to be installed by users. For downlight devices used in normal home, it would be important to consider convenience for installation, safety and replacement.

Usually, LED light devices need certain driver circuits supplying proper driving currents to LED modules so as to make LED modules operating normally. Driver circuits occupy certain space and makes assembling of LED light devices more difficultly.

Therefore, it would be beneficial to provide designs that are easily to be installed, assembled, and thus even help decrease total cost. On the other hand, it would be even better if further advantages may be introduced in the same products.

SUMMARY OF INVENTION

According to an embodiment of the present invention, a LED light apparatus includes a first substrate, multiple first LED modules, a driver circuit, a first fluorescent layer, a connector and a light passing shell.

Such LED light apparatus may refer to a bulb component or may refer to a complete light device by adding further components like caps. The first substrate may be made of transparent material, metal material, or other material.

The first LED modules are mounted on the substrate. The first LED modules may each include one or more LED chips. Besides, the first LED modules may include one type of LED chips or mixed with multiple types of LED chips with different optical characteristics, e.g. color temperatures. The first LED modules may be packed with flip chip packaging or other packaging methods.

Wires or pre-installed metal strips on the first substrate may be used for interconnecting the first LED modules based on a predetermined connection logic, e.g. connecting the first LED modules in series, in parallel, in series and in parallel, or in multiple separate independent paths.

The driver circuit is mounted on the first substrate and electrically connected to the first LED modules for providing a driving current to the plurality of first LED modules. The driver circuit may include components like rectifier, filter, surge protection components. The driver circuit may be full function to convert an external power source to the driving current. The driver circuit may co-work with other driver circuit in the LED light apparatus together to provide the driving current to the first LED modules.

The first fluorescent layer covers both the driver circuit and the first LED modules. In some embodiments, when the first fluorescent layer is not transparent, the driver circuit is covered below the first fluorescent layer. In some embodiments, the first fluorescent layer may include multiple segments or multiple layers with different optical characteristics.

The connector has a first end electrically connecting to the driver circuit. The connector is used as an electrical interface for the driver circuit to an external power source. In following disclosure, it is explained that there are various ways to implement the connector mentioned here.

The light passing shell may be a transparent or translucent housing for letting light of the plurality of first LED modules transmitting out of the LED light apparatus. For example, the light passing shell may have a traditional incandescent light bulb shell style. Other shapes are also possible, depending on different design requirements.

The light passing shell is also used for encapsulating the substrate, the plurality of first LED modules, the driver circuit, the first fluorescent layer and at least a part of the connector. The space encapsulated by the light passing shell may be a closed space filling with heat dissipation gas or protection gas, like He, for enhance heat dissipation and/or protecting the components of the LED light apparatus.

In some embodiments, the connector may have a first portion inside the enclosed space of the light passing shell, a second portion embedded in the light passing shell and a third portion outside the enclosed space of the light passing shell. Specifically, the light passing shell may be made of glass material and have a bottom neck part. The second portion embedded in the light passing shell refers to a part of the connector embedded in the neck part of the glass light passing shell.

Furthermore, the connector has a second end connecting to an external power source. Specifically, the connector is an intermediate component between the components like the first LED modules enclosed by the light passing shell and the components like a cap or an external power source.

The first substrate may be made of various material. For example, the first substrate may be made of glass, plastic or other transparent material. In some other examples, the first substrate may be made of non-transparent material like aluminum. Furthermore, the first substrate may be rigid or flexible. For flexible substrate, the substrate may be shaped as a three-dimension structure extended in multiple planes in a three-dimension space.

In some embodiments, the first substrate has a base part and multiple extended parts. For example, the first substrate includes base part and five extended parts. Each extended part has one end connected to the base part, just like a palm with five extended fingers. In some embodiments, the driver circuit may be disposed on the base part while the first LED modules are disposed on the multiple extended parts.

In some embodiments, furthermore, the extended parts may have different lengths to form various desired shapes, e.g. to simulate a flame. In such case, there may be at least two extended parts having different lengths.

In some embodiments, the first substrate may be transparent, e.g. made with glass or plastic. When the first substrate is transparent, the back side of the first substrate may be covered with another fluorescent layer so that the light of the first LED modules may also be emitted from the back side of the first substrate. Furthermore, the emitted light may have desired optical characteristics, e.g. with required spectrum distribution or eliminating undesired blue light.

Furthermore, the lateral side of the first substrate may be covered with another fluorescent layer, for preventing undesired light escaped from the lateral side. For example, blue light may be converted by the fluorescent layer on the lateral side of the first substrate to non-blue light. In current market, this would be a nice feature for protecting human eyes more completely.

In some embodiments, the lateral side of the first substrate may be processed with certain concave or convex structures for enhancing attachment of the lateral side of the first substrate and the fluorescent layer thereon.

In some embodiments, a LED light apparatus may have multiple substrates mounted with LED modules. In some embodiments, all substrates may be also mounted with one or more driver circuits. In some other embodiments, the driver circuit in some substrate may be shared to LED modules mounted on other substrates. In some embodiments, furthermore, driver circuits on multiple substrate may together form a full function driver circuit for driving LED modules so that only a part of components need to be mounted on a substrate, instead all components.

These substrates may be disposed in different planes in a three-dimension space. For example, the substrates may form a three-dimension structure for emitting light in more directions to make better light effect. Such arrangement may also help dissipate heat by multiple components instead of focus on one component.

In some embodiments, the connector has a first part and a second part. The first part is connected to the second part by plugging. Specifically, the first substrate mentioned above may have two tail ends as the first part of the connector. The light passing shell may be made of glass and two metal socket pins as the second part of the connector may be embedded with a glass neck of the light passing shell. During manufacturing, the first part of the connector fixed to the first substrate mounted with the first LED modules are plugged into the second part of the connector.

There are at least two ways for forming the connection between the first part and the second part of the connector. For example, the first part may be a socket while the second part may be a pin, or the first part may be a pin while the second part may be a socket. The socket mentioned here may be an elastic clip by curving a metal sheet so that when an opposite pin enters the socket, the elastic clip fastens and keep the opposite pin to stay at its location. An inverse hook on the pin or the socket may further fasten the connection between the first part and the second part.

The second part of the connector, particularly with a part embedded in glass neck of the light passing shell may be selected with thermal expansion ratio similar to glass to further enhance robustness of the LED light apparatus. In contrast, since the first part and the second part may be separate in such embodiments, the first part of the connector may be made of material different from the second part of the connector.

In some embodiments, the first part of the connector has an elastic socket, and the second part of the connector has a pin. When the pin is plugged into the elastic socket, the pin is fastened to the elastic socket forming an electrical connection.

In some other embodiments, the first part of the connector may be two sockets like the elastic socket mentioned above for receiving two pins partially embedded in the neck part of the light passing shell.

In some embodiments, the connector may include a first connector part and a second connector part. The first connector part and the second connector part are made of different materials. The second connector part is at least partially embedded in the light passing shell.

In some embodiments, a difference ratio between thermal expansion coefficients of the second connector part and the light passing shell is less than 20%. For example, when the light passing shell is made of glass, the second connector part may be selected with molybdenum (Mo), or a multi-layer wire.

Such multi-layer wire may be a Lead-in-Wire providing the required vacuum tight glass-to-metal seal, including a base wire and a sheath. The ratio of both compounds may be in well-balanced proportions. Such control helps guarantee to obtain a vacuum tight conductor through glass.

An example procedure to produce such multi-layer wire may include in the set-up line, the cladding is realized: a Copper clad on a core wire (e.g. Nickel-Iron). This Copper cladded wire is welded to achieve an endless length and drawn to obtain the requested diameter. Finally, the surface of the multi-layer wire is treated to guarantee a good adhesion to the glass. Depending on the application requirements this well-defined surface treatment can be done by borating, oxidizing or nickel-plating.

With such design, protection gas or thermal dissipation gas may be well kept in the light passing shell.

In some embodiments, the light passing shell is made of glass material, and an interior surface of the light passing shell is disposed with an optical effect material. For example, the optical effect material may help reflecting, softening or applying any other optical effect.

In some embodiments, the light passing shell has a bulb shell part and an air passing part together forming an enclosure space. The second connector part is fixed in the air passing part. Heat dissipating gas is enclosed in the enclosure space.

In some embodiments, the air passing part is more like a neck of the light passing shell. As mentioned above, the connector may have a second part of a second connector part partially embedded in the neck of the light passing shell. The air passing part may have a gas passage originally connected to a pipe for installing gas inside the light passing shell. The pipe may be removed during manufacturing and the gas passage is sealed so as the gas is kept inside the light passing shell.

In some embodiments, there is an insulator disposed between the driver circuit and the first fluorescent layer. The insulator may be made of a separate cover, or a disposed layer upon the driver circuit as an intermediate component between the fluorescent layer and the driver circuit. This may help protect the driver circuit during attaching the fluorescent layer, enhance heat dissipation, increase fixing robustness between the fluorescent layer, and/or even reflect light to prevent waste of light emitting on surface of the driver circuit.

The insulator may be a rigid cover, like an aluminum cover. Surface of the insulator may be added with certain convex or concave structures for increasing fixing ability to the fluorescent layer. The insulator, in some embodiments, may be a light reflective material.

In some embodiments, the driver circuit may include a surge protection component and a rectifier component. There may be other driver components not directly integrated to the first substrate. For example, an additional wireless circuit may be further disposed in the LED light apparatus.

In some embodiments, the first substrate is an elongated strip. There may be multiple such elongated strips installed in an LED light apparatus to appear like a traditional incandescent light bulb. The multiple elongated strips are disposed with a bracket or certain supporting structures to form a three-dimension structures in multiple planes in a three-dimension space so as to emit light in more angles.

In some embodiments, the driver circuit is disposed at or near an edge end of the elongated strip. If there are two driver circuit components, the two driver circuit components may be disposed at two opposite ends of the elongated strip.

As mentioned above, all elongated strips may be disposed with the same driver circuit. Alternatively, different driver components may be disposed on different elongated strips. Some elongated strips may even not be disposed with a driver circuit.

DETAILED DESCRIPTION

Figure 1:
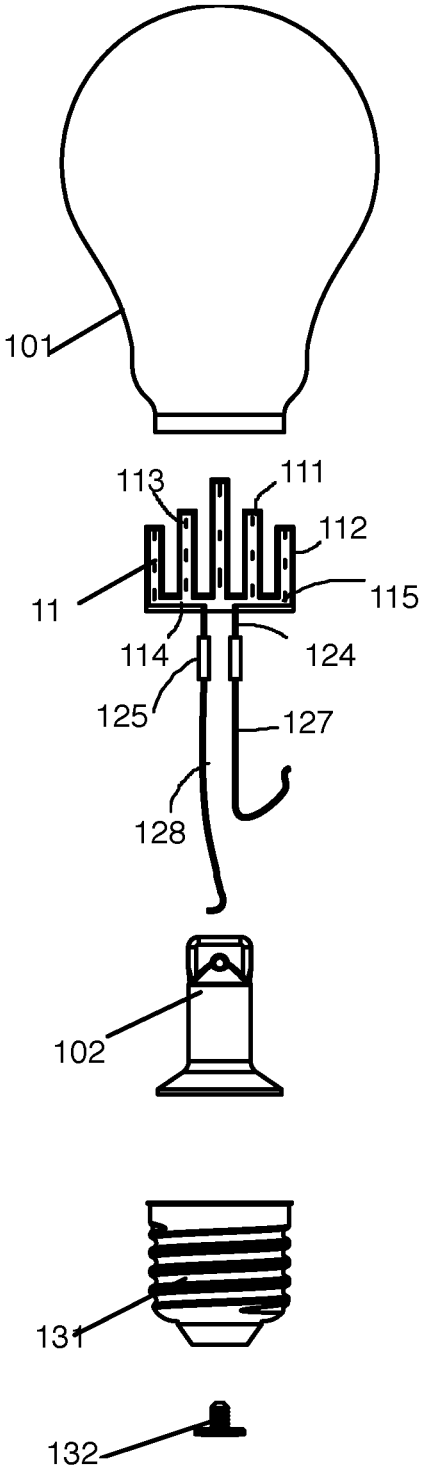
FIG. 1 illustrates an exploded view of an LED light apparatus embodiment.

Please refer to FIG. 1. FIG. 1 illustrates a LED light apparatus embodiment.

In FIG. 1, a light passing shell has a dome part 101 and a neck part 102. In this example, the dorm part 101 and the neck part 102 are both made of glass material.

The LED light apparatus also includes a substrate 11. There are multiple LED modules 113 and a driver circuit 115 mounted on the substrate 11. A fluorescent layer covers both the LED modules 113 and the driver circuit 11.

In this example, the substrate 11 has a base part 114 and multiple extended parts 111 and 112. The lengths of some extended parts 111 and 112 are different.

The driver circuit 115 and the LED modules 113 are electrically connected to outside via a connector. In this example, the connector has a first part 124 and a second part 125. The first part 124 may be made of nickel while the second part 125 may be made of Mo or Dumet wires. The second part 125 is at least partially embedded in the neck part 102 of the light passing shell. There are further two terminals, which may refer as part of the connector, connecting to two electrodes 131, 12 of a light cap, like an Edison cap, for receiving an external power source.

Figure 2:
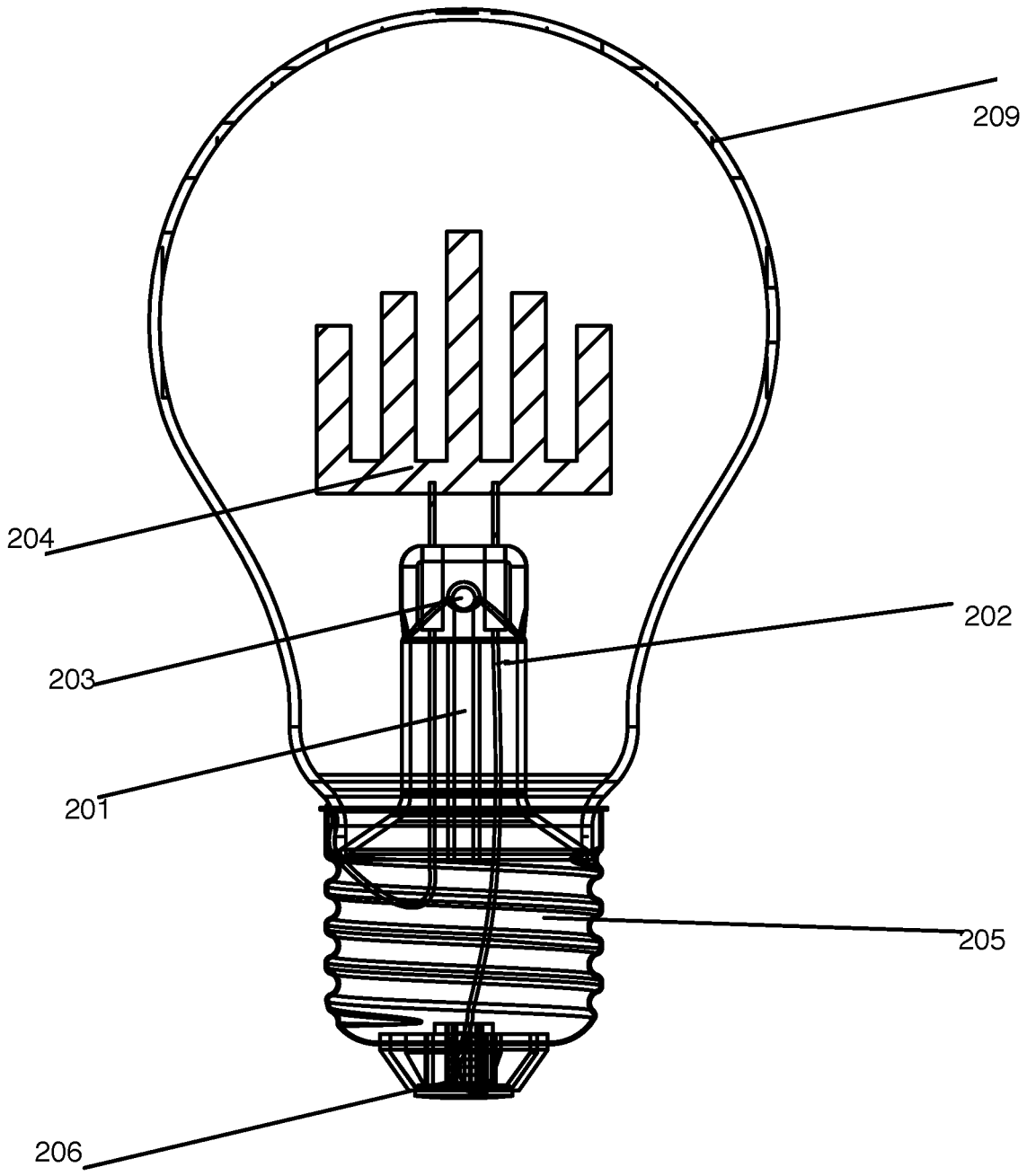
FIG. 2 illustrates assembled result of the embodiment in FIG. 1.

Please refer to FIG. 2. FIG. 2 shows an assembled result of the embodiment in FIG. 1.

In FIG. 2, the light passing shell 209 allows light of the LED modules on the substrate 204 to escape out of the LED light apparatus. The neck part of the light passing shell has a gas passage 203 for filling protective and/or heat dissipation gas like He into the enclosing space of the light passing shell 209. There is a pipe 201 connecting to the gas passage 203 that may be partly removed during manufacturing. As mentioned above, part of the connector is embedded in the neck part of the light passing shell. With the connector, the LED light apparatus may receive an external power source from two electrodes 205, 206.

Figure 3:
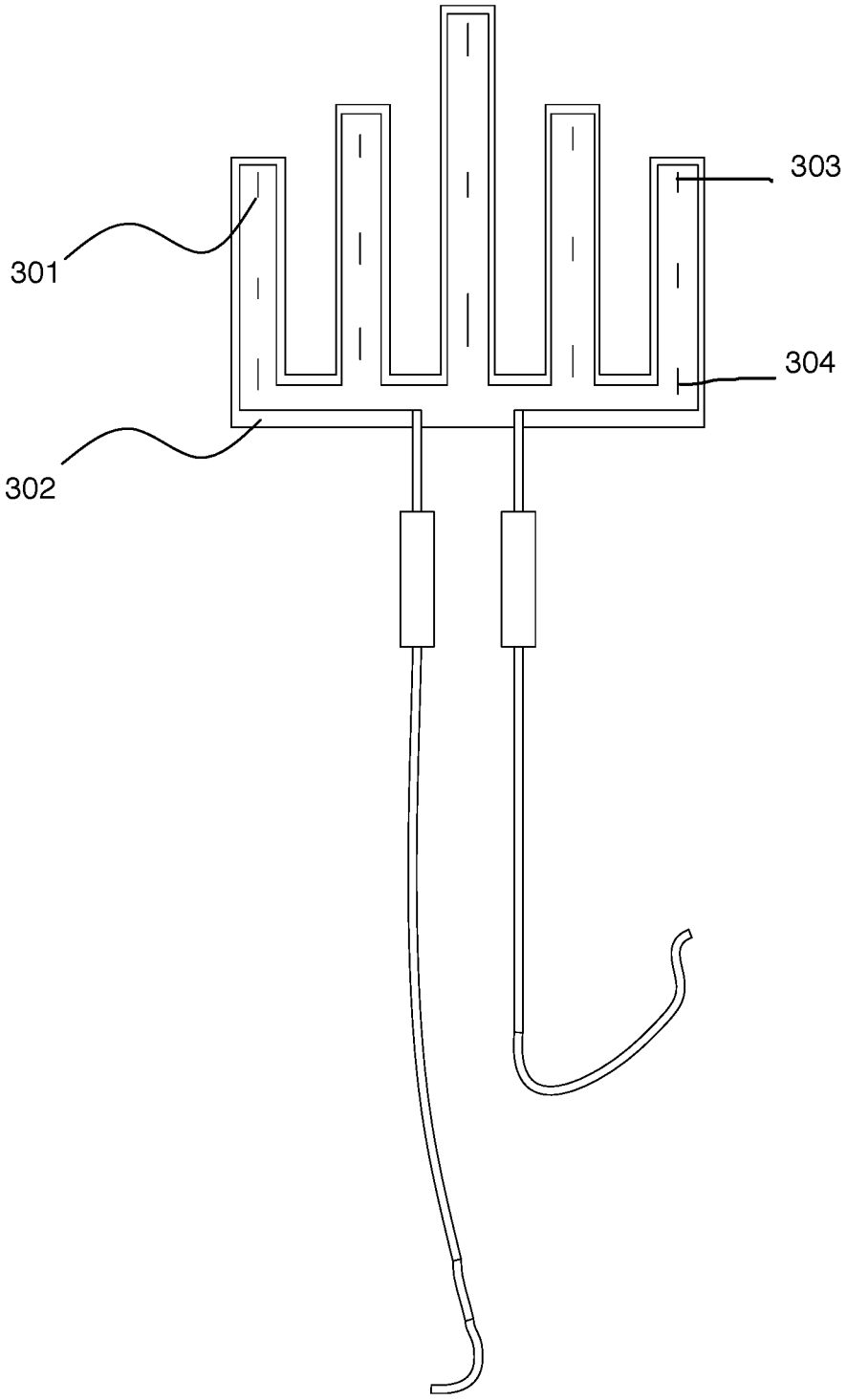
FIG. 3 illustrates components of the embodiment of FIG. 1.

Please refer to FIG. 3, which illustrates a component used in embodiments like FIG. 1.

In FIG. 3, LED modules 303 are mounted on extended parts 301 while a driver circuit 304 is mounted on a base part 302. The extended parts 301 may be even folded or curved to form a three-dimension structure. A fluorescent layer may directly cover the extended parts 301 and gaps therebetween.

Figure 4:
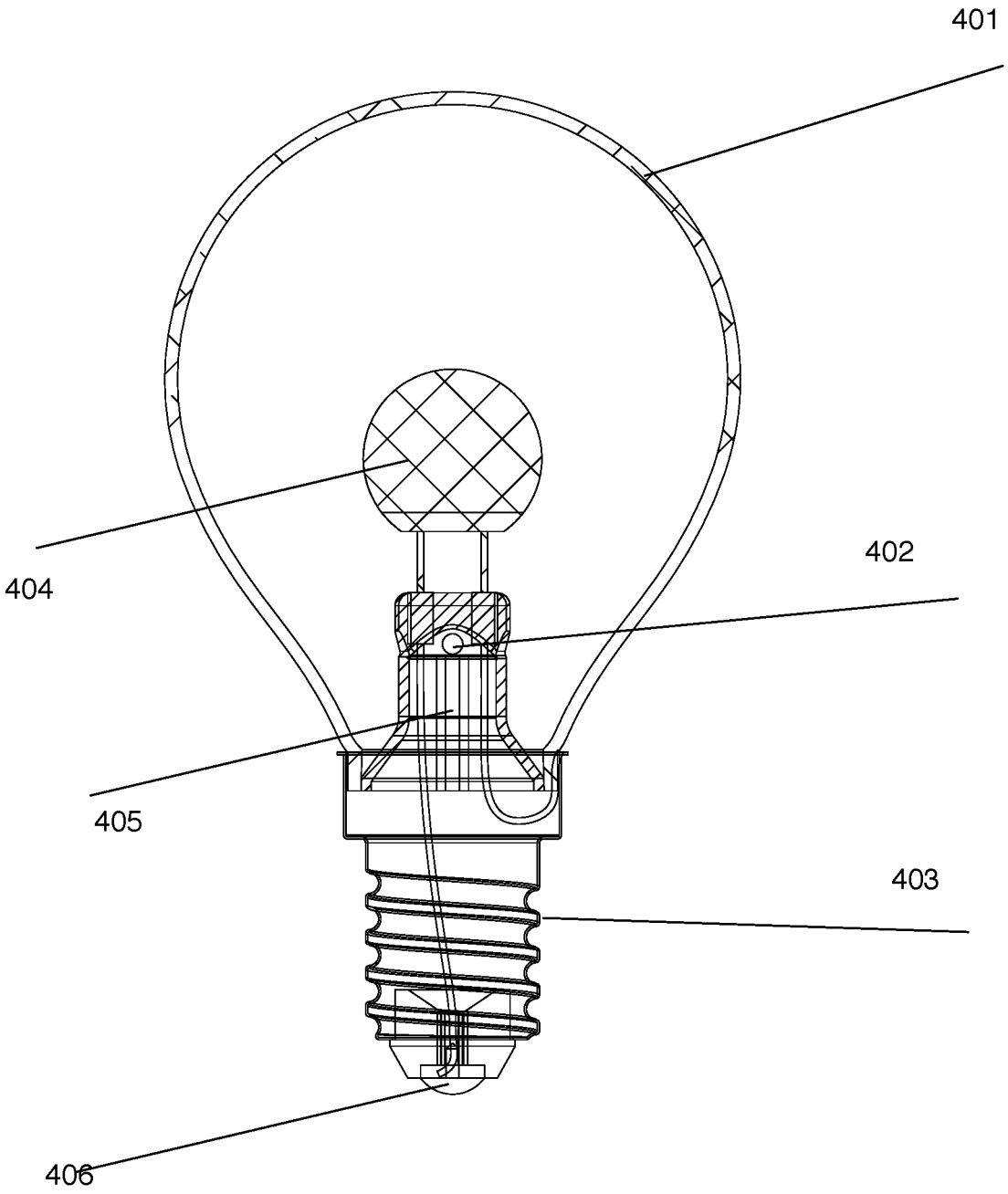
FIG. 4 illustrates another LED light apparatus embodiment.

Please refer to FIG. 4. FIG. 4 illustrates another embodiment.

In FIG. 4, the LED light apparatus has a light passing shell 401, a light source module 404, a gas passage 402 that is sealed during manufacturing, a neck part 405 and two electrodes 403, 406 connecting to an outside power source.

The light source module 404 includes a substrate. The substrate is mounted with LED modules and one or more driver circuit components. A fluorescent layer covers the LED modules and the driver circuit components. Unlike the light source module shape, FIG. 4 shows another design.

The LED modules may include multiple types of LED modules, e.g. with different color temperatures, so as to mix different variation of light output.

Figure 5:
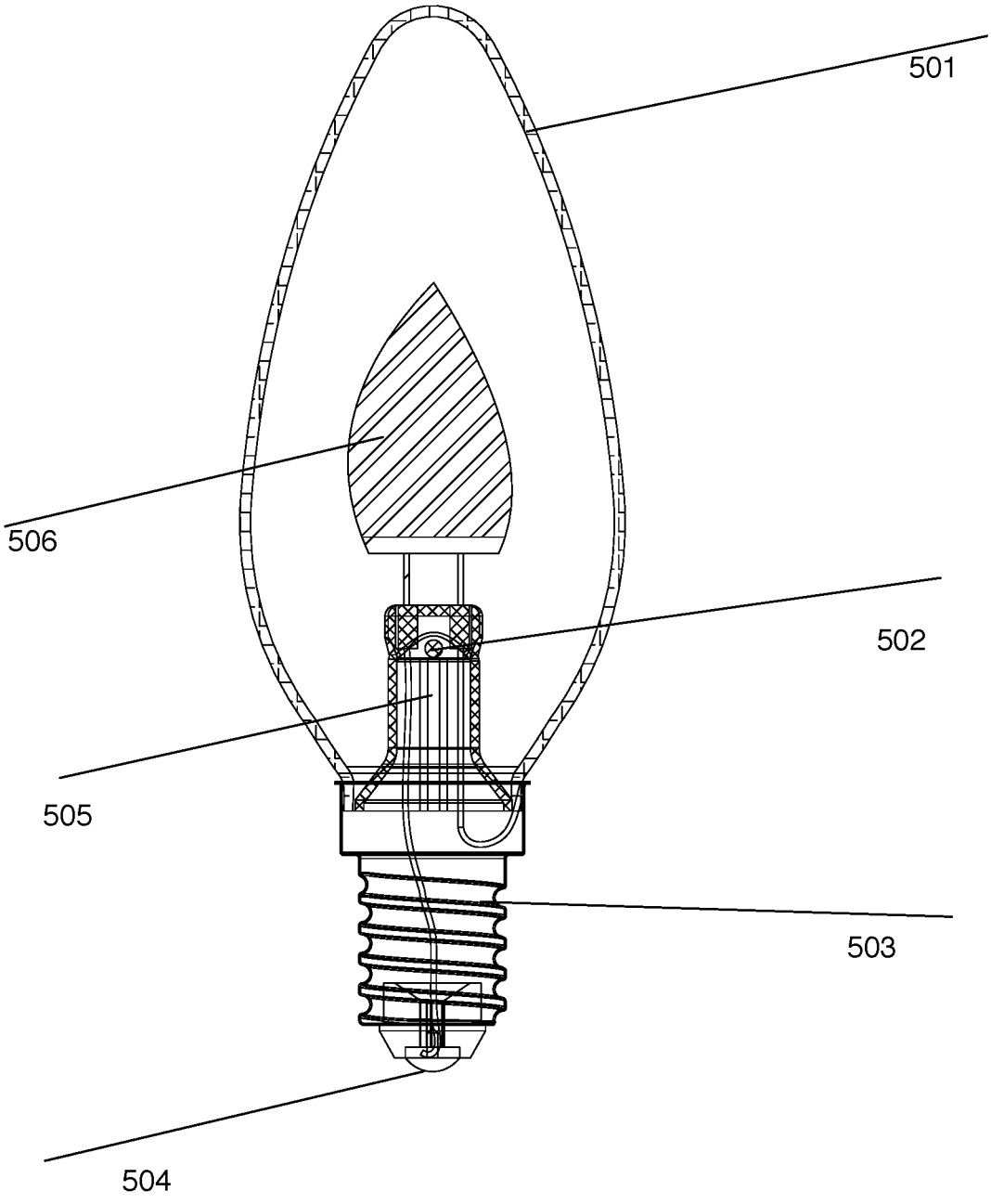
FIG. 5 illustrates another LED light apparatus embodiment.

Please refer to FIG. 5, which illustrates another embodiment.

In FIG. 5, the LED light apparatus includes a light passing shell 501, a light source module with a different shape as FIG. 4, a gas passage 502, a neck part 505, and two electrodes 503, 504.

Therefore, there may be other shapes for the light source module and the light passing shell, depending on different design needs.

According to an embodiment of the present invention, a LED light apparatus includes a first substrate, multiple first LED modules, a driver circuit, a first fluorescent layer, a connector and a light passing shell.

Such LED light apparatus may refer to a bulb component or may refer to a complete light device by adding further components like caps. The first substrate may be made of transparent material, metal material, or other material.

The first LED modules are mounted on the substrate. The first LED modules may each include one or more LED chips. Besides, the first LED modules may include one type of LED chips or mixed with multiple types of LED chips with different optical characteristics, e.g. color temperatures. The first LED modules may be packed with flip chip packaging or other packaging methods.

Wires or pre-installed metal strips on the first substrate may be used for interconnecting the first LED modules based on a predetermined connection logic, e.g. connecting the first LED modules in series, in parallel, in series and in parallel, or in multiple separate independent paths.

The driver circuit is mounted on the first substrate and electrically connected to the first LED modules for providing a driving current to the plurality of first LED modules. The driver circuit may include components like rectifier, filter, surge protection components. The driver circuit may be full function to convert an external power source to the driving current. The driver circuit may co-work with other driver circuit in the LED light apparatus together to provide the driving current to the first LED modules.

The first fluorescent layer covers both the driver circuit and the first LED modules. In some embodiments, when the first fluorescent layer is not transparent, the driver circuit is covered below the first fluorescent layer. In some embodiments, the first fluorescent layer may include multiple segments or multiple layers with different optical characteristics.

The connector has a first end electrically connecting to the driver circuit. The connector is used as an electrical interface for the driver circuit to an external power source. In following disclosure, it is explained that there are various ways to implement the connector mentioned here.

The light passing shell may be a transparent or translucent housing for letting light of the plurality of first LED modules transmitting out of the LED light apparatus. For example, the light passing shell may have a traditional incandescent light bulb shell style. Other shapes are also possible, depending on different design requirements.

The light passing shell is also used for encapsulating the substrate, the plurality of first LED modules, the driver circuit, the first fluorescent layer and at least a part of the connector. The space encapsulated by the light passing shell may be a closed space filling with heat dissipation gas or protection gas, like He, for enhance heat dissipation and/or protecting the components of the LED light apparatus.

In some embodiments, the connector may have a first portion inside the enclosed space of the light passing shell, a second portion embedded in the light passing shell and a third portion outside the enclosed space of the light passing shell. Specifically, the light passing shell may be made of glass material and have a bottom neck part. The second portion embedded in the light passing shell refers to a part of the connector embedded in the neck part of the glass light passing shell.

Furthermore, the connector has a second end connecting to an external power source. Specifically, the connector is an intermediate component between the components like the first LED modules enclosed by the light passing shell and the components like a cap or an external power source.

The first substrate may be made of various material. For example, the first substrate may be made of glass, plastic or other transparent material. In some other examples, the first substrate may be made of non-transparent material like aluminum. Furthermore, the first substrate may be rigid or flexible. For flexible substrate, the substrate may be shaped as a three-dimension structure extended in multiple planes in a three-dimension space.

In some embodiments, the first substrate has a base part and multiple extended parts. For example, the first substrate includes base part and five extended parts. Each extended part has one end connected to the base part, just like a palm with five extended fingers. In some embodiments, the driver circuit may be disposed on the base part while the first LED modules are disposed on the multiple extended parts.

In some embodiments, furthermore, the extended parts may have different lengths to form various desired shapes, e.g. to simulate a flame. In such case, there may be at least two extended parts having different lengths.

In some embodiments, the first substrate may be transparent, e.g. made with glass or plastic. When the first substrate is transparent, the back side of the first substrate may be covered with another fluorescent layer so that the light of the first LED modules may also be emitted from the back side of the first substrate. Furthermore, the emitted light may have desired optical characteristics, e.g. with required spectrum distribution or eliminating undesired blue light.

Furthermore, the lateral side of the first substrate may be covered with another fluorescent layer, for preventing undesired light escaped from the lateral side. For example, blue light may be converted by the fluorescent layer on the lateral side of the first substrate to non-blue light. In current market, this would be a nice feature for protecting human eyes more completely.

In some embodiments, the lateral side of the first substrate may be processed with certain concave or convex structures for enhancing attachment of the lateral side of the first substrate and the fluorescent layer thereon.

In some embodiments, a LED light apparatus may have multiple substrates mounted with LED modules. In some embodiments, all substrates may be also mounted with one or more driver circuits. In some other embodiments, the driver circuit in some substrate may be shared to LED modules mounted on other substrates. In some embodiments, furthermore, driver circuits on multiple substrate may together form a full function driver circuit for driving LED modules so that only a part of components need to be mounted on a substrate, instead all components.

These substrates may be disposed in different planes in a three-dimension space. For example, the substrates may form a three-dimension structure for emitting light in more directions to make better light effect. Such arrangement may also help dissipate heat by multiple components instead of focus on one component.

In some embodiments, the connector has a first part and a second part. The first part is connected to the second part by plugging. Specifically, the first substrate mentioned above may have two tail ends as the first part of the connector. The light passing shell may be made of glass and two metal socket pins as the second part of the connector may be embedded with a glass neck of the light passing shell. During manufacturing, the first part of the connector fixed to the first substrate mounted with the first LED modules are plugged into the second part of the connector.

There are at least two ways for forming the connection between the first part and the second part of the connector. For example, the first part may be a socket while the second part may be a pin, or the first part may be a pin while the second part may be a socket. The socket mentioned here may be an elastic clip by curving a metal sheet so that when an opposite pin enters the socket, the elastic clip fastens and keep the opposite pin to stay at its location. An inverse hook on the pin or the socket may further fasten the connection between the first part and the second part.

The second part of the connector, particularly with a part embedded in glass neck of the light passing shell may be selected with thermal expansion ratio similar to glass to further enhance robustness of the LED light apparatus. In contrast, since the first part and the second part may be separate in such embodiments, the first part of the connector may be made of material different from the second part of the connector.

In some embodiments, the first part of the connector has an elastic socket, and the second part of the connector has a pin. When the pin is plugged into the elastic socket, the pin is fastened to the elastic socket forming an electrical connection.

In some other embodiments, the first part of the connector may be two sockets like the elastic socket mentioned above for receiving two pins partially embedded in the neck part of the light passing shell.

In some embodiments, the connector may include a first connector part and a second connector part. The first connector part and the second connector part are made of different materials. The second connector part is at least partially embedded in the light passing shell.

In some embodiments, a difference ratio between thermal expansion coefficients of the second connector part and the light passing shell is less than 20%. For example, when the light passing shell is made of glass, the second connector part may be selected with molybdenum (Mo), or a multi-layer wire.

Such multi-layer wire may be a Lead-in-Wire providing the required vacuum tight glass-to-metal seal, including a base wire and a sheath. The ratio of both compounds may be in well-balanced proportions. Such control helps guarantee to obtain a vacuum tight conductor through glass.

An example procedure to produce such multi-layer wire may include in the set-up line, the cladding is realized: a Copper clad on a core wire (e.g. Nickel-Iron). This Copper cladded wire is welded to achieve an endless length and drawn to obtain the requested diameter. Finally, the surface of the multi-layer wire is treated to guarantee a good adhesion to the glass. Depending on the application requirements this well-defined surface treatment can be done by borating, oxidizing or nickel-plating.

With such design, protection gas or thermal dissipation gas may be well kept in the light passing shell.

In some embodiments, the light passing shell is made of glass material, and an interior surface of the light passing shell is disposed with an optical effect material. For example, the optical effect material may help reflecting, softening or applying any other optical effect.

In some embodiments, the light passing shell has a bulb shell part and an air passing part together forming an enclosure space. The second connector part is fixed in the air passing part. Heat dissipating gas is enclosed in the enclosure space.

In some embodiments, the air passing part is more like a neck of the light passing shell. As mentioned above, the connector may have a second part of a second connector part partially embedded in the neck of the light passing shell. The air passing part may have a gas passage originally connected to a pipe for installing gas inside the light passing shell. The pipe may be removed during manufacturing and the gas passage is sealed so as the gas is kept inside the light passing shell.

In some embodiments, there is an insulator disposed between the driver circuit and the first fluorescent layer. The insulator may be made of a separate cover, or a disposed layer upon the driver circuit as an intermediate component between the fluorescent layer and the driver circuit. This may help protect the driver circuit during attaching the fluorescent layer, enhance heat dissipation, increase fixing robustness between the fluorescent layer, and/or even reflect light to prevent waste of light emitting on surface of the driver circuit.

The insulator may be a rigid cover, like an aluminum cover. Surface of the insulator may be added with certain convex or concave structures for increasing fixing ability to the fluorescent layer. The insulator, in some embodiments, may be a light reflective material.

In some embodiments, the driver circuit may include a surge protection component and a rectifier component. There may be other driver components not directly integrated to the first substrate. For example, an additional wireless circuit may be further disposed in the LED light apparatus.

Figure 6:
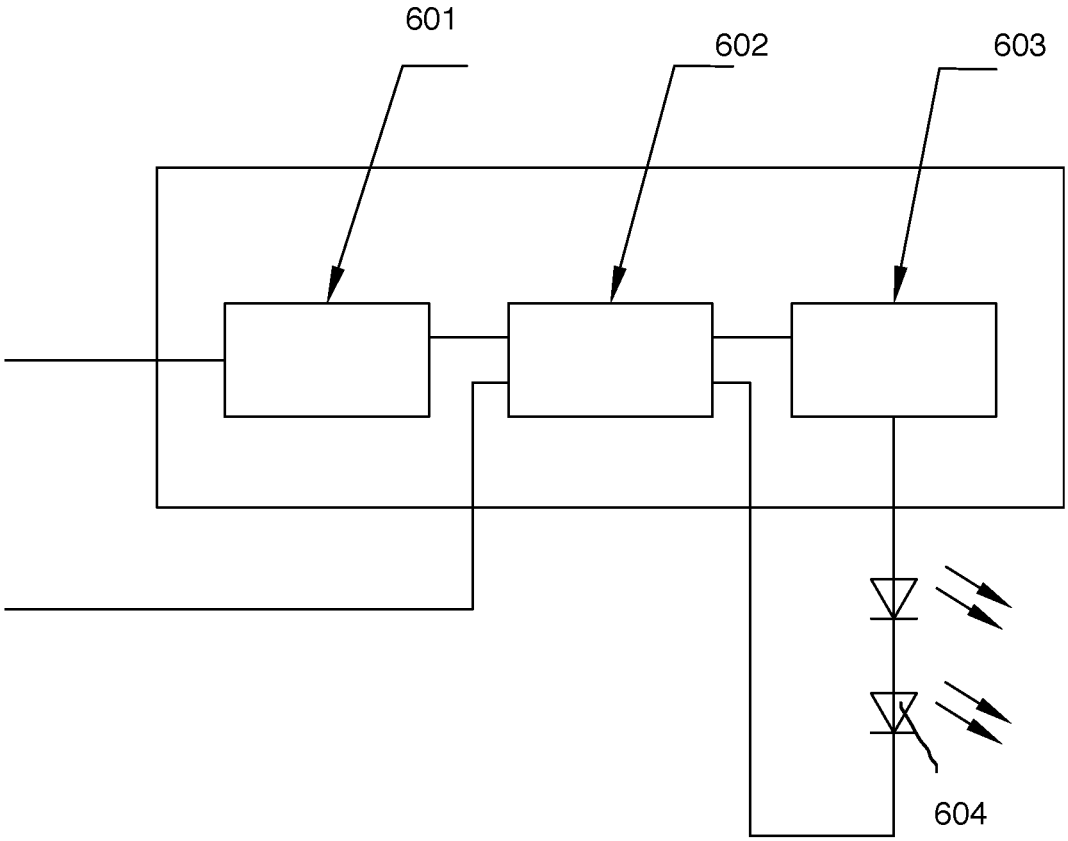
FIG. 6 illustrates a circuit logic diagram in an embodiment.

Please refer to FIG. 6, which illustrates a logic circuit diagram. The driver circuit may have multiple components like a surge protection circuit 601, a rectifier circuit 602 and a constant current circuit 603 for providing a stable current to LED modules 604.

These components may be separately disposed at different positions of the substrate, as mentioned above. Some components may be shared among substrates or placed outside the substrate.

In some embodiments, the first substrate is an elongated strip. There may be multiple such elongated strips installed in an LED light apparatus to appear like a traditional incandescent light bulb. The multiple elongated strips are disposed with a bracket or certain supporting structures to form a three-dimension structures in multiple planes in a three-dimension space so as to emit light in more angles.

In some embodiments, the driver circuit is disposed at or near an edge end of the elongated strip. If there are two driver circuit components, the two driver circuit components may be disposed at two opposite ends of the elongated strip.

As mentioned above, all elongated strips may be disposed with the same driver circuit. Alternatively, different driver components may be disposed on different elongated strips. Some elongated strips may even not be disposed with a driver circuit.

Figure 7:
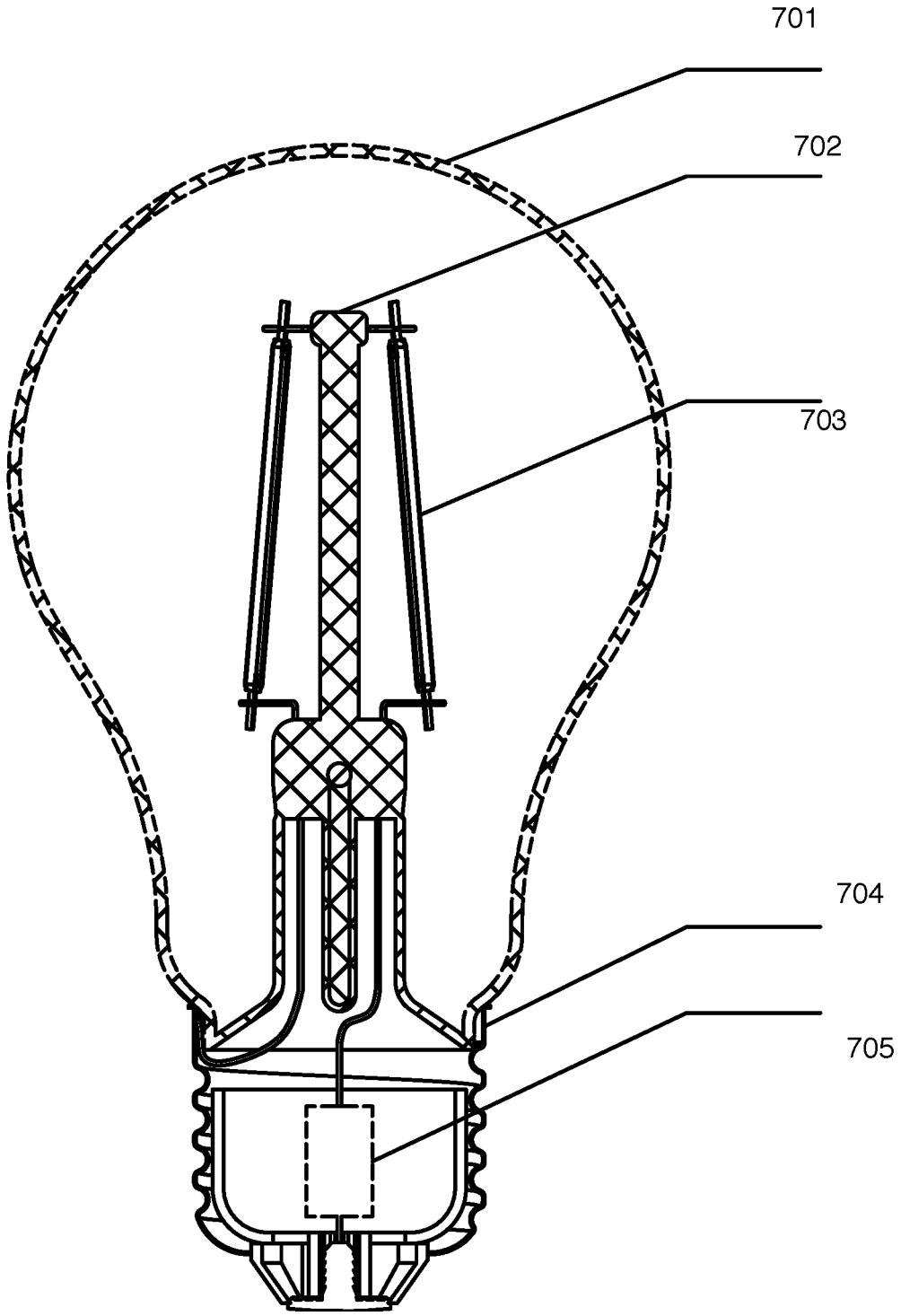
FIG. 7 illustrates another LED light apparatus embodiment.

Please refer to FIG. 7. FIG. 7 illustrates a LED light apparatus embodiment with elongated strip substrate.

In FIG. 7, the LED light apparatus has a light passing shell 701. A central support 702 is used for fixing multiple substrates 703, which are elongated strip shape. There is a neck part 704 for connecting a cap.

The place in the cap originally for disposing a driver circuit 705 now may be placed with a heat sink or part of the driver circuit while the substrate 703 is now mounted with driver circuits, too.

Figure 8:
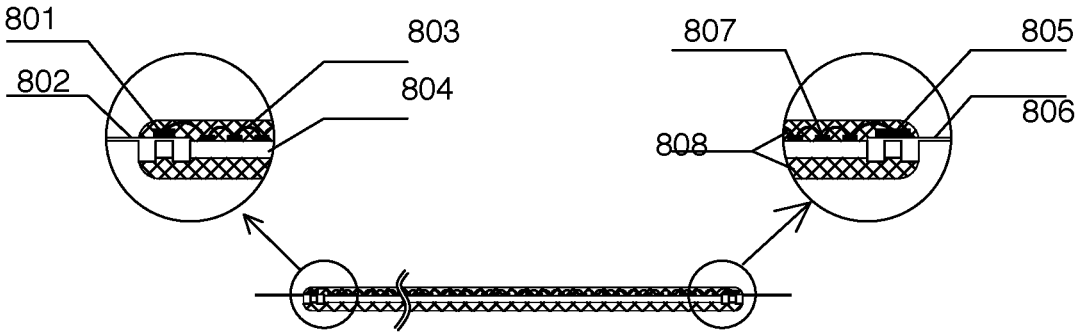
FIG. 8 illustrates components in an embodiment.

Please refer to FIG. 8. FIG. 8 illustrates an elongated substrate example.

In FIG. 8, an elongated substrate 804 is mounted with LED modules 803, 807. Both sides of the elongated substrate 804 is covered with fluorescent layers 808. There are two driver circuit components 801, 805 disposed on two opposite ends of the elongated substrate 804. The driver circuit components 801, 805 are also covered by the fluorescent layers 808. Two connectors 802, 806 are used for connecting the LED modules 803, 807 and the driver circuit components 801, 805 to outside.

Figure 9:
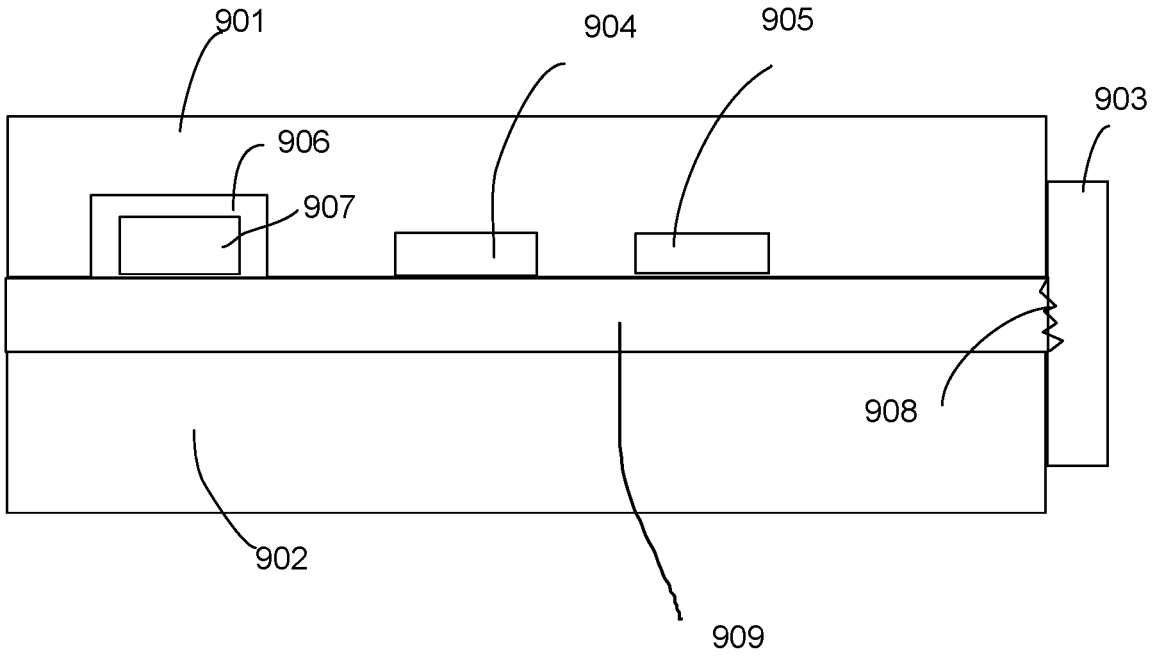
FIG. 9 illustrates another component view.

Please refer to FIG. 9, which illustrates components in an embodiment.

In FIG. 9, multiple LED modules 904, 905 are disposed on a substrate 909. In addition, a driver circuit 907 is also disposed on the substrate 909. An insulator 906 like a cover is disposed between the driver circuit 907 and a first fluorescent layer 901.

In this example, the substrate 909 is transparent and there is a second fluorescent layer 902 disposed on the back side of the substrate 909. Furthermore, there is a third fluorescent layer 903 disposed on a lateral side of the substrate 909 to prevent undesired light escape and to convert undesired light to expected light spectrum output.

To enhance attachment of the third fluorescent layer 903 to the substrate 909, the lateral side of the substrate 909 may be processed with multiple convex and/or concave structures 908.

Figure 10:
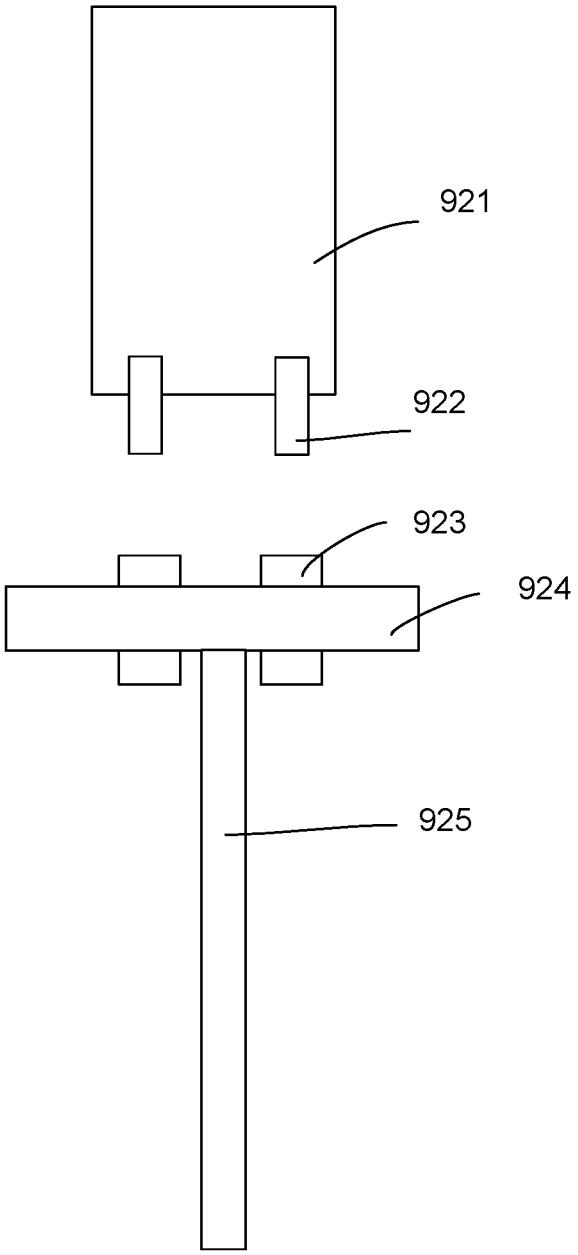
FIG. 10 illustrates relation between a substrate and a connector.

Please refer to FIG. 10. FIG. 10 illustrates relation between a substrate and a connector.

In FIG. 10, the substrate 921 is firstly fixed to first parts 922 of a connector. The first parts 922 of the connector, during manufacturing are plugged to corresponding second parts 923 of the connector. Part of the second parts 923 of the connector are embedded in a neck part 924 of a light passing shell. The pipe 925 is used for directing gas into the light passing shell and may be removed during manufacturing.

Figure 11:
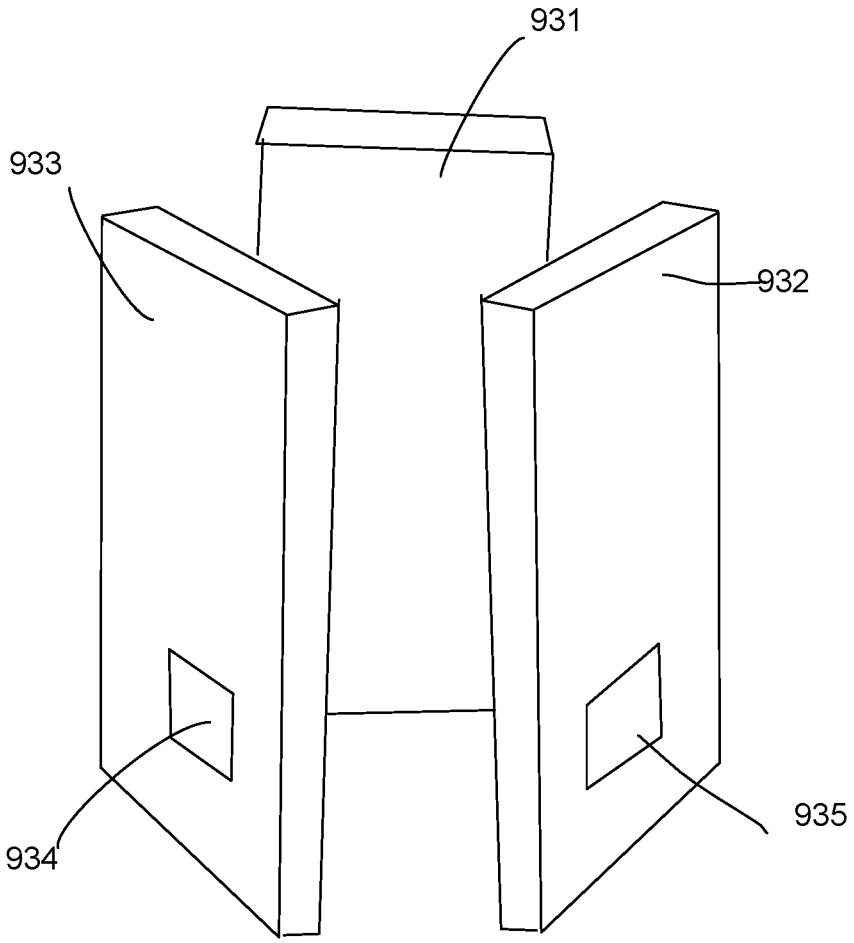
FIG. 11 illustrates multiple substrates forming a three-dimension structure.

Please refer to FIG. 11. FIG. 11 illustrates an embodiment of multiple substrates.

In FIG. 11, a LED light apparatus has three substrates 931, 932, 933 mounted with LED modules. The three substrates 931, 932, 933 are disposed in different planes forming a three-dimension structure. In this example, only the substrates 932, 933 are mounted with driver circuits 935, 934. Furthermore, the driver circuits 934, 935 may be different. In other words, the driver circuits 934, 935 may be shared among LED modules.

Figure 12:
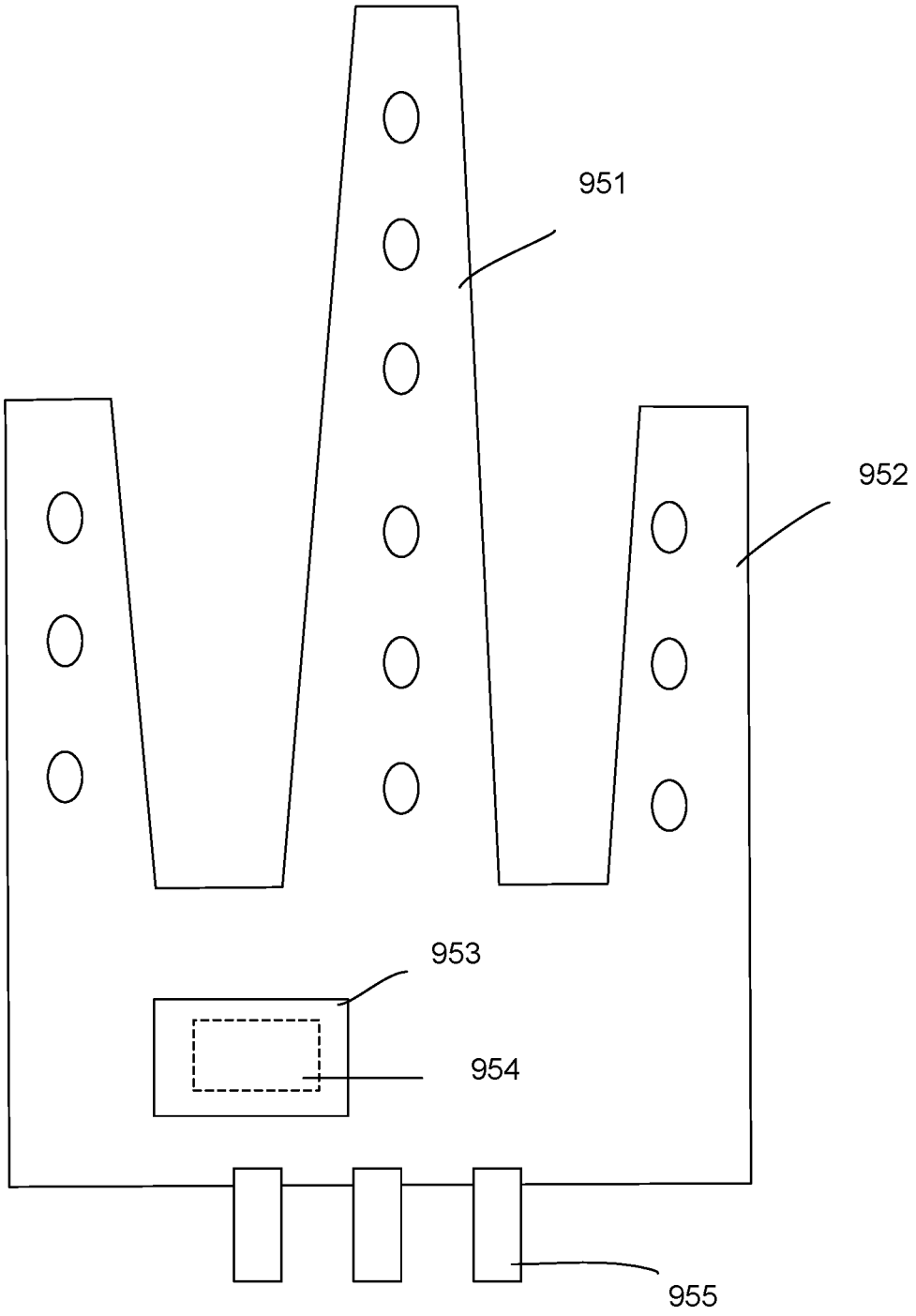
FIG. 12 illustrates another component view.

Please refer to FIG. 12. FIG. 12 illustrates another embodiment.

In FIG. 12. There are three pins 955, two for transmitting electricity and one for control signals. More pins may be installed depending on different design needs. The driver circuit 954 is protected by a cover 953. There are two extended parts 951, 952 of a substrate having different lengths.

In addition to the above-described embodiments, various modifications may be made, and as long as it is within the spirit of the same invention, the various designs that can be made by those skilled in the art are belong to the scope of the present invention.

The invention claimed is:

1. A LED light apparatus, comprising:

a first substrate;

a plurality of first LED modules mounted on the first substrate;

a driver circuit mounted on the first substrate and electrically connected to the plurality of first LED modules for providing a driving current to the plurality of first LED modules;

a first fluorescent layer covering the driver circuit and the plurality of first LED modules;

a connector with a first end electrically connecting to the driver circuit; and a light passing shell for letting light of the plurality of first LED modules transmitting out of the LED light apparatus and for encapsulating the substrate, the plurality of first LED modules, the driver circuit, the first fluorescent layer and at least a part of the connector, the connector having a second end connecting to an external power source, wherein the first substrate has a base part and multiple extended parts, the extended part has one end connected to the base part, the plurality of first LED modules are mounted on the extended part, and the driver circuit is mounted on the base part.

2. The LED light apparatus of claim 1, wherein the first fluorescent layer also covers the driver circuit.

3. The LED light apparatus of claim 1, wherein at least two of the multiple extended parts have different lengths.

4. The LED light apparatus of claim 1, wherein the first substrate is a transparent substrate and there is a second fluorescent layer covering a back side of the first substrate.

5. The LED light apparatus of claim 1, wherein the plurality of first LED modules are blue light LED modules, and there is a third fluorescent layer covering a lateral side of the first substrate.

6. The LED light apparatus of claim 1, further comprising a second substrate mounted with a plurality of second LED modules, the first substrate and the second substrate being disposed in different planes in a three-dimension space.

7. The LED light apparatus of claim 1, wherein the plurality of second LED modules receive the driving current provided by the driver circuit.

8. The LED light apparatus of claim 1, wherein the connector has a first part and a second part, the first part is connected with the second part by plugging.

9. The LED light apparatus of claim 8, wherein the first part of the connector has an elastic socket, and the second part of the connector has a pin, when the pin is plugged into the elastic socket, the pin is fastened to the elastic socket forming an electrical connection.

10. The LED light apparatus of claim 9, wherein the second part of the connector is partially fixed in the light passing shell, and the first part of the connector is fixed to the substrate.

11. The LED light apparatus of claim 1, wherein the connector comprises a first connector part and a second connector part, the first connector part and the second connector part are made of different materials, the second connector part is at least partially embedded in the light passing shell.

12. The LED light apparatus of claim 11, wherein a difference ratio between thermal expansion coefficients of the second connector part and the light passing shell is less than 20%.

13. The LED light apparatus of claim 11, wherein the light passing shell is made of glass material, and an interior surface of the light passing shell is disposed with an optical effect material.

14. The LED light apparatus of claim 11, wherein the light passing shell has a bulb shell part and an air passing part together forming an enclosure space, the second connector part is fixed in the air passing part, heat dissipating gas is enclosed in the enclosure space.

15. The LED light apparatus of claim 1, wherein there is an insulator disposed between the driver circuit and the first fluorescent layer.

16. The LED light apparatus of claim 1, wherein the driver circuit comprises a surge protection component and a rectifier component.

17. The LED light apparatus of claim 1, further the first substrate is an elongated strip.

18. The LED light apparatus of claim 17, wherein the driver circuit has a first component and a second component disposed on two opposite ends of the elongated strip.

19. The LED light apparatus of claim 17, further comprising a second substrate of an elongated strip mounted with a plurality of second LED modules, the second substrate and the first substrate are disposed in different planes in a three-dimension space.

20. The LED light apparatus of claim 19, further comprising an additional driver circuit to co-work with the driver circuit for supplying the driving current to the plurality of first LED modules and the plurality of the second LED modules.

* * * * *